United States Patent [19]

Dutt

[11] Patent Number: 4,676,278

[45] Date of Patent: Jun. 30, 1987

[54] FORMING FABRIC

[75] Inventor: William H. Dutt, Rensselaer, N.Y.

[73] Assignee: Albany International Corp., Menands, N.Y.

[21] Appl. No.: 917,615

[22] Filed: Oct. 10, 1986

[51] Int. Cl.[4] ..... D03D 25/00

[52] U.S. Cl. ..... 139/383 A; 428/229; 139/420 R

[58] Field of Search ..... 139/383 R, 383 A, 425 A, 139/384 R, 420 R, 426 R; 428/229, 245, 259

[56] References Cited

U.S. PATENT DOCUMENTS

| | | | |
|---|---|---|---|
| 3,000,771 | 9/1961 | Runton | 139/408 |
| 3,745,066 | 7/1973 | Bleuer | 139/420 R |
| 4,149,571 | 4/1979 | Burroughs | 139/383 A |
| 4,359,501 | 11/1982 | Di Tullio | 139/383 R |

*Primary Examiner*—Henry S. Jaudon

*Attorney, Agent, or Firm*—Kane, Dalsimer, Sullivan, Kurucz

[57] ABSTRACT

A forming fabric is disclosed having crimped machine direction monofilament yarns alternating with uncrimped monofilament yarns. The fabric provides optimum stability and seam strength.

2 Claims, 7 Drawing Figures

FORMING FABRIC

BACKGROUND OF THE INVENTION

1. Field of the Invention

The invention relates to paper machine clothing and more particularly relates to forming fabrics for the fabrication of belts, employed in the forming section of a papermaking machine.

2. Brief Description of the Prior Art

Papermaking machines are well known in the art. The modern papermaking machine is in essence a device for removing water from the paper furnish. The water is removed sequentially in three stages or sections of the machine. In the first or forming section, the furnish is deposited on a moving forming wire and water drained through the wire to leave a paper sheet or web having a solids content of circa 18 to 25 percent by weight. The formed web is carried into a wet press felt section and passed through one or more nip presses on a moving press felt to remove sufficient water to form a sheet having a solids content of 36 to 44 percent by weight. This sheet is transferred to the dryer section of the papermaking machine where dryer felts press the paper sheet to hot steam heated cylinders to obtain a 92 to 93 percent solids content. The efficiency at each state of papermaking is dependent on the efficiency of the preceding step. Thus, overall efficiency is dependent on the effectiveness of the first or forming fabric in the initial step.

Representative of prior art descriptions of prior art forming fabrics are those found in U.S. Pat. Nos. 3,858,623; 4,095,622; 4,149,571; 4,344,464; and 4,453,573.

It is well known in the prior art to produce forming fabric for paper machines wherein the fabric is flat woven and then joined with a seam which has proper papermaking characteristics.

In order to operate successfully on the forming section of the paper machine, a forming fabric must have a given modulus in order to stay within the machine direction length adjustments available on the machine. To achieve the required modulus woven fabrics are heatset under the application of heat and machine direction tension. Depending on the relationship of the diameter and resultant modulus of the machine direction yarns vs the cross machine directions yarns, crimp produced in weaving may be transferred from the machine direction yarns to the cross machine direction yarns. As a result, the machine direction yarns may become essentially straight. Although it is desirable to have the straight machine direction yarn to achieve proper modulus, it is extremely difficult to achieve required seam strength with machine direction yarns that do not have sufficient crimp.

It is the object of this invention to provide a fabric structure which has both sufficient machine direction modulus and proper seam strength to operate successfully.

We have discovered that by proper weaving techniques, it is possible to achieve different crimp configurations in different portions of the machine direction (warp) yarns system. The weave can be arranged in such a manner that a portion of the machine directions yarns are essentially straight, and a second portion of the machine directions yarns have substantial crimp. The first portion will provide the fabric with the proper modulus. The second portion will provide the necessary crimp required to achieve good seam strength.

In order to produce a fabric of this characteristic, at least two independent machine direction (warp) yarn systems must be provided in the loom. This requirement is due to the fact that in weaving the interlacing of the independent warp yarn systems will differ significantly requiring that the warp yarns systems be independently controlled.

With the structured forming fabrics of the present invention, many of the above-described shortcomings of the prior art are removed. Forming belts constructed according to the invention may be fabricated from an all monofilament fabric which is more resistant to degradative elements. The overall operating life of the forming wires is significantly increased over prior art forming wires.

SUMMARY OF THE INVENTION

The invention comprises a papermachine forming fabric, which comprises;

interwoven machine direction and cross-machine direction synthetic, polymeric resin yarns;

a plurality of machine direction yarns being crimped yarns and additional machine direction yarns uncrimped.

DETAILED DESCRIPTION OF THE PREFERRED EMBODIMENTS OF THE INVENTION

Those skilled in the art will gain an appreciation of the preferred embodiments of the invention by a reading of the following description in conjunction with a viewing of the accompanying drawings of FIGS. 1–7, inclusive.

Figure 1:
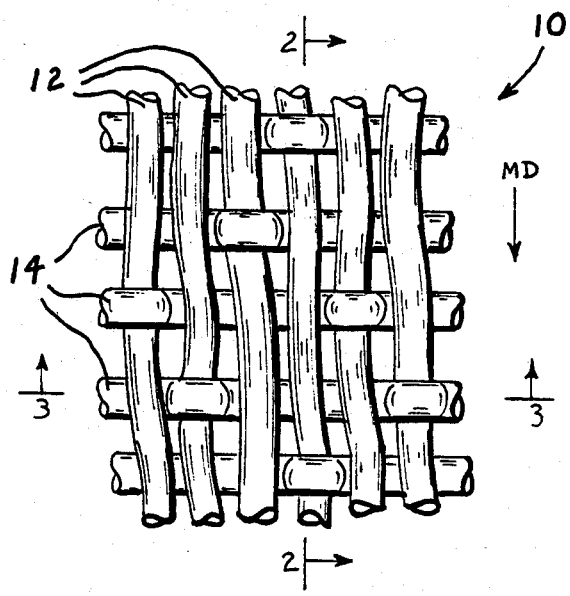
FIG. 1 PRIOR ART
FIG. 1 is a top view of a portion of an embodiment forming fabric of the prior art.

FIG. 1 is a top view of a portion of an embodiment forming fabric 10 of the prior art. The forming fabric 10 is a single layer flat woven fabric. The fabric 10 is made up by an interweaving of the machine direction yarn 12 with a plurality of cross-machine direction yarns 14. The yarns 12, 14 shown in FIG. 1 are monofilaments and may be extruded monofilaments of any known synthetic, polymeric resin in any conventional denier. Representative of preferred monofilament yarns are monofilament yarns of polyesters, polyamides, polyaramids, polyolefins and the like which do not absorb high proportions of moisture. A preferable material for these yarns is 8 mil monofilament synthetic polyester. It should be noted that forming fabric 10 may be a multilayered fabric, as, for example, that which is disclosed in Justus et al., U.S. Pat. No. 3,127,308, in which case the teachings of this invention are applicable to each layer or one or more layers thereof. Preferably, the yarns 12, 14 are substantially nondeformable, and, in the case where a fabric embodying the present invention is produced by shrinking the cross-machine direction yarns, as described, hereinafter, is susceptible to shrinking and maintaining its reduced length. By nondeformable is meant that the yarns in the completed fabric are of such a nature that when the fabric is in use their cross-sectional dimensions will remain substantially the same under pressure applied thereto as a result of tension applied to the fabric. As will be seen, this characteristic is utilized to ensure that the diameter of the cross-machine direction yarns will not be less than the average distance measured in the cross-machine direction between adjacent machine direction yarns.

Figure 2:
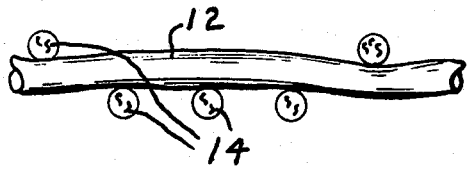
FIG. 2 PRIOR ART
FIG. 2 is a view along lines 2—2 of FIG. 1.
Figure 3:
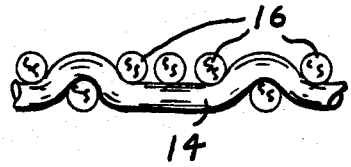
FIG. 3 PRIOR ART
FIG. 3 is a view along lines 3—3 of FIG. 1.

FIG. 1 depicts a fabric 10 which incorporates a four-harness satin weave. In one suitable such construction there are 84 picks per inch (machine direction yarns) and 49 ends per inch (cross-machine direction yarns). While FIG. 1 depicts a four-harness satin weave, other types of weaves, for example, twill weaves, may be utilized. Referring to FIGS. 2 and 3, it can be seen that, for example, by weaving monofilament yarns in a four-harness satin weave having 49 ends per inch and 84 picks per inch, a fabric 10 is produced wherein the axes of the machine direction yarns 12 lie substantially in the same longitudinal plane.

As depicted in FIG. 1, machine direction yarns 12 have crimps therein, herein referred to as "lateral crimps," which undulate in the cross-machine direction in the longitudinal plane of the fabric; that is, in viewing either surface of the fabric, the machine direction yarns 12 undulate to the left and right. This undulation is such that the axes of adjacent machine direction yarns are furthest apart at those points where a cross-machine direction yarn interlaces therebetween, as, for example, where cross-machine direction yarn 12 interlaces from beneath the fabric 10 and up between adjacent machine direction yarns 12. Similarly, the axes of adjacent machine direction yarns are closest together at those points where there is no cross-machine direction yarns therebetween. Referring to FIG. 1, it can be seen that many of the interstices in the fabric have a trapezoidal configuration as a result of the lateral crimp in the machine direction yarns. As explained in detail hereinafter, these lateral crimps result from (1) the use of yarns which are substantially nondeformable; (2) the maintaining of the machine direction yarns 12 in substantially the same longitudinal plane; and (3) the crowded weave pattern referred to above. The number of crimps in the yarns 12 is not critical, but advantageously is within the range of from about 8 to 20 crimps per inch. This prior art construction resists straightening out, being held in the crimped condition by the lateral force exerted by the cross-machine direction yarns. Since all of the yarns are substantially nondeformable, the cross-machine direction yarns 12 offer an opposing force thereby preventing the removal of the lateral crimp in the machine direction yarns 12.

Figure 4:
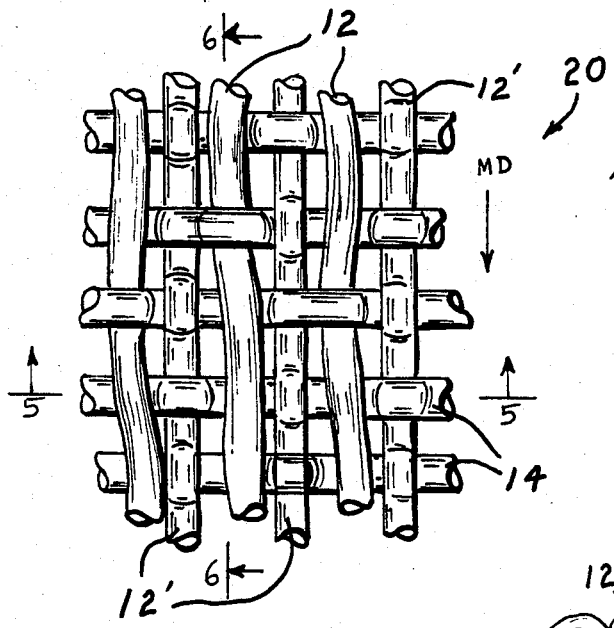
FIG. 4 is a top view as in FIG. 1, but of an embodiment fabric of the invention.
Figure 5:
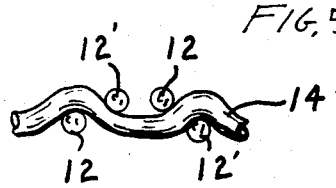
FIG. 5 is a view along lines 5—5 of FIG. 4.
Figure 6:
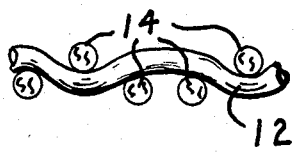
FIG. 6 is a view along lines 6—6 of FIG. 4.

The improved fabrics 20 of the invention as shown in FIGS. 4–6, inclusive are improved over the above-described prior art fabrics in that alternate machine direction yarns 12 are uncrimped as shown in the straight yarns 12'. The improved fabric 20 of the invention envisions using yarns of similar modulus, controlling crimp geometry by independently controlling the weaving tension on each yarn system. Therefore, the system containing the crimp provides good seam strength in the normal woven seam employed. The system with lower crimp provides good elongation characteristics to the fabric as a whole.

Figure 7:
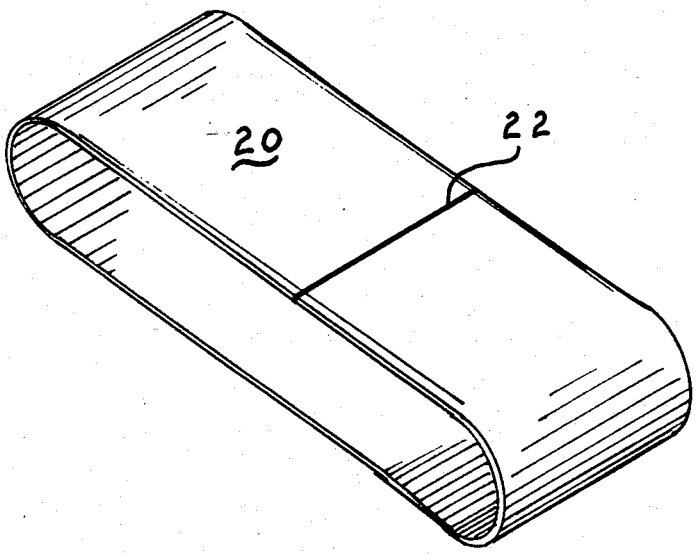
FIG. 7 is a view-in-perspective of a forming fabric belt, made from the fabric of the invention, for use in the forming section of a papermaker's machine.

The fabric 20 of the invention may be made endless, as shown in FIG. 7, by joining the ends of the flat woven fabric with a conventional seam 22, to make a forming wire belt 24. Following the manufacture of the fabrics of the invention, the fabrics may be heat-set to stabilize the fabric and to draw the yarns into desired relative position. The degree of heat-setting required to achieve the desired structure of the fabric will of course vary depending on the polymer nature of the yarns. However, optimum times, temperatures and tensions placed on the fabric during heat-setting can be determined by those skilled in the art, employing trial and error technique for the different yarn materials. In general, heat-setting may be carried out at temperatures of from about 150° F. to 400° F. for from 15 to 60 minutes.

What is claimed is:

1. A papermachine forming fabric, which comprises;

interwoven machine direction and cross-machine direction synthetic, polymeric resin, monofilament yarns;

a plurality of said machine direction yarns being crimped yarns and the remainder of said machine direction yarns being uncrimped; the crimps in said crimped yarns being perminent lateral crimps in the cross-machine direction;

said crimped and said umcriped yarns having similar modulus and being substantially non-deformable.

2. The fabric of claim 1 wherein alternate machine directin yarns are the crimped yarns.

* * * * *

UNITED STATES PATENT AND TRADEMARK OFFICE

CERTIFICATE OF CORRECTION

PATENT NO. : 4,676,278

DATED : June 30, 1987

INVENTOR(S) : William H. Dutt

It is certified that error appears in the above-identified patent and that said Letters Patent is hereby corrected as shown below:

Column 4, line 45, "umcriped" should read --uncrimped--;

Column 4, line 48, "directin" should read -- direction -- .

Signed and Sealed this

Tenth Day of May, 1988

*Attest:*

DONALD J. QUIGG

*Attesting Officer*

*Commissioner of Patents and Trademarks*